US006557456B2

(12) United States Patent
Norton et al.

(10) Patent No.: US 6,557,456 B2
(45) Date of Patent: May 6, 2003

(54) CUSHIONED ACTUATOR

(75) Inventors: Kenneth E. Norton, Greene, NY (US); Gerard T. Perkins, Greene, NY (US)

(73) Assignee: The Raymond Corporation, Greene, NY (US)

( * ) Notice: Subject to any disclaimer, the term of this patent is extended or adjusted under 35 U.S.C. 154(b) by 0 days.

(21) Appl. No.: 09/865,209

(22) Filed: May 24, 2001

(65) Prior Publication Data

US 2002/0174766 A1 Nov. 28, 2002

(Under 37 CFR 1.47)

(51) Int. Cl.[7] ..... F01B 11/02
(52) U.S. Cl. ..... 92/85 B
(58) Field of Search ..... 92/85 B

(56) References Cited

U.S. PATENT DOCUMENTS

| | | | | |
|---|---|---|---|---|
| 3,162,578 A | * 12/1964 | Allen | 92/85 B |
| 3,213,760 A | 10/1965 | Carr | 91/395 |
| 3,877,344 A | 4/1975 | Langland | 91/406 |
| 3,955,479 A | 5/1976 | McLuckie | 92/128 |
| 4,397,218 A | 8/1983 | Spring | 91/26 |
| 4,538,954 A | 9/1985 | Luebke | 414/633 |
| 4,638,717 A | 1/1987 | Carr | 91/26 |
| 4,706,781 A | * 11/1987 | Ikimi et al. | 91/399 |
| 4,763,800 A | 8/1988 | Engler et al. | 212/195 |
| 4,848,519 A | 7/1989 | Ericson et al. | 187/1 R |
| 5,022,496 A | 6/1991 | Klopfleisch et al. | 187/9 |
| 5,657,834 A | 8/1997 | Plaugher et al. | 187/226 |
| 6,283,008 B1 | 9/2001 | Schöwald et al. | 91/392 |

FOREIGN PATENT DOCUMENTS

| | | | |
|---|---|---|---|
| DE | 12 93 026 | 4/1969 | |
| DE | 22 54 495 | 5/1974 | F15B/15/22 |
| DE | 36 06 515 | 8/1986 | F15B/15/14 |
| EP | 0 622 331 | 11/1994 | B66F/9/08 |
| EP | 0 866 026 | 9/1998 | B66F/9/08 |

* cited by examiner

*Primary Examiner*—Edward K. Look
*Assistant Examiner*—Michael Leslie
(74) *Attorney, Agent, or Firm*—Quarles & Brady LLP

(57) ABSTRACT

An actuator for use with a lift truck having an extendible mast includes an elongated housing and an axial bore formed in said housing. The bore has a first end and a second end. A ram is slidably and sealingly mounted in the bore for axial movement between an extended position and a retracted position, and has one end disposed in the bore and an opposing end extending out of the bore second end. A pressure ring is slidably and sealingly mounted in the bore between the ram one end and the bore second end, wherein filling the bore with a fluid causes the ram to move from the retracted position toward the extended position, and engagement of the ram one end with the pressure ring traps fluid between the pressure ring and the bore second end to resist movement of the ram toward the extended position. In a preferred embodiment the ram one end includes a piston plug body with an axial piston plug bore formed in the piston plug body. The piston plug bore has a first end and a second end, and the piston plug bore first end is in fluid communication with the bore formed in said housing. A piston is slidably and sealingly mounted in the piston plug bore, and has an end extending out of the piston plug bore second end toward the first end of the bore formed in said housing. An accumulator biasing member urges the piston away from the piston plug bore second end.

29 Claims, 4 Drawing Sheets

CUSHIONED ACTUATOR

STATEMENT REGARDING FEDERALLY SPONSORED RESEARCH

Not Applicable

CROSS REFERENCES TO RELATED APPLICATIONS

Not Applicable

BACKGROUND OF THE INVENTION

The present invention relates to fluid actuators, in particular to a cushioned fluid actuator, such as a hydraulic cylinder, for use in a multi-stage mast assembly of a lift truck, wherein the actuator has a cushioning assembly which can reduce shock loads encountered in the transition between stages of the multi-stage mast assembly.

Known lift trucks, such as Reach-Fork®, Easi™ Orderpicker, and Pacer™ Truck trucks available from The Raymond Corporation in Greene, N.Y., include a vertically extendible mast supporting a carriage which incorporates "mast staging" to lift a carriage to considerable heights.

"Mast staging" refers to a method of lifting/lowering loads on a lift truck carriage in stages (sections). To lift, a fixed hydraulic ram extends until it reaches its end of stroke, whereupon, successive rams (stages) continues the lift. Unfortunately, a shock load is generated as one ram decelerates rapidly at its end of stroke and the next ram accelerates upward. These shock loads can propagate through the lift truck to increase the discomfort of the operator, and can destabilize loads on the carriage.

One known method of mast staging intended to reduce shock loads is disclosed in U.S. Pat. No. 5,022,496. The disclosed method slows the rate of movement of the carriage immediately before and during a stage transition, and then increases the speed of the carriage once the transition is completed. This method changes the speed of the carriage as it moves in a vertical direction which can destabilize a load on the carriage, and cause discomfort to an operator. In addition, this method reduces productivity due to slowing the carriage down through the transition.

Another known method of mast staging intended to reduce shock loads is disclosed in U.S. Pat. No. 5,657,834. The disclosed method incorporates spring elements at the end of each mast stage to cushion the transition between stages. This particular method increases the complexity of the mast assembly, and the difficulty of retrofitting an existing mast assembly. In addition, this method reduces the overall vehicle reliability due to the life of the spring elements.

SUMMARY OF THE INVENTION

The present invention provides an actuator for use with a lift truck having an extendible mast. The actuator includes an elongated housing and an axial bore formed in said housing. The bore has a first end and a second end. A ram is slidably and sealingly mounted in the bore for axial movement between an extended position and a retracted position, and has one end disposed in the bore and an opposing end extending out of the bore second end. A pressure ring is slidably and sealingly mounted in the bore between the ram one end and the bore second end, wherein filling the bore with a fluid causes the ram to move from the retracted position toward the extended position, and engagement of the ram one end with the pressure ring traps fluid between the pressure ring and the bore second end to resist movement of the ram toward the extended position.

In another aspect of the invention, the ram one end includes a piston plug body with an axial piston plug bore formed in the piston plug body. The piston plug bore has a first end and a second end, and the piston plug bore first end is in fluid communication with the bore formed in said housing. A piston is slidably and sealingly mounted in the piston plug bore, and has an end extending out of the piston plug bore second end toward the first end of the bore formed in said housing. An accumulator biasing member urges the piston away from the piston plug bore second end.

A general objective of the present invention is to provide an actuator for use with a lift truck multi-stage mast assembly which reduces mast staging shock. This objective is accomplished by providing an actuator with a pressure ring which causes the actuation of a second mast stage prior a first mast stage reaching a fully extended position.

Another objective of the present invention is to provide an actuator for use with a lift truck multi-stage mast assembly which can minimize hydraulic shocks which can occur during a transition between mast stages. This objective is accomplished by providing a ram having on one end a piston plug which can accumulate fluid to minimize hydraulic shocks.

This and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE INVENTION

Figure 1:
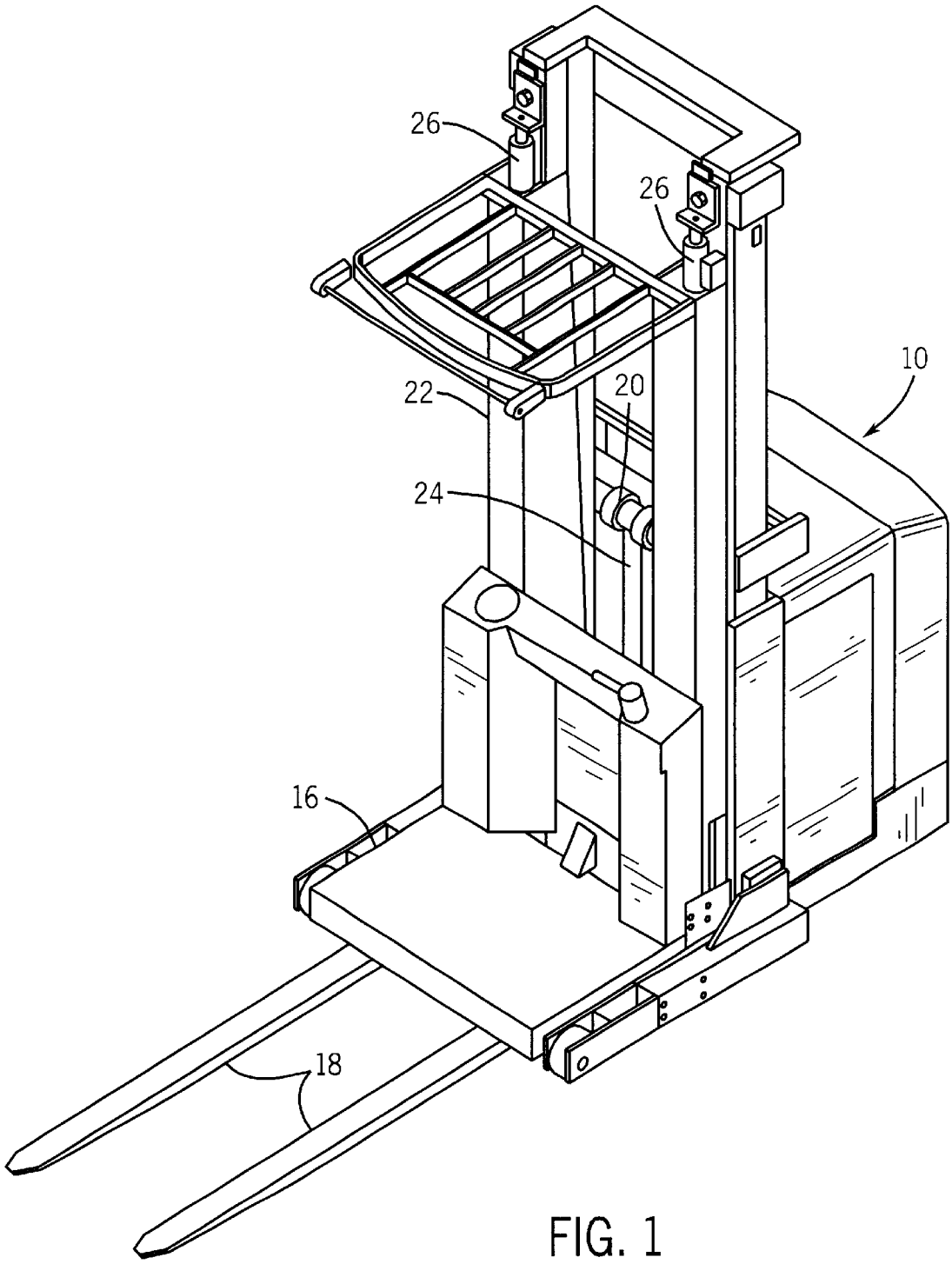
FIG. 1 is a perspective view of a lift truck incorporating the present invention.

As shown in FIG. 1, a lift truck 10 includes an extendible multi-stage mast assembly 14 mounted thereon. The mast assembly 14 lifts a carriage 16 and a pair forks 18 which extend from underneath the carriage 16. The forks 18 vertically support a pallet (not shown). The lift truck 10 can be any commercially available lift truck having a multi-stage assembly, such as a Raymond Reach-Fork®, Easi™ Orderpicker, and Pacer™ Truck available from Raymond Corporation, Greene, N.Y.

In the embodiment shown in FIGS. 1–7, the mast assembly 14 includes a first hydraulic stage 20 and a second hydraulic stage 22. The first hydraulic stage 20 lifts the carriage 16 and forks 18, to a predetermined height. Once the carriage 16 reaches the predetermined height, the second hydraulic stage 22 lifts the carriage 16, forks 18, and first hydraulic stage to a desired height, as determined by an operator. Each hydraulic stage 20, 22 includes at least one hydraulic cylinder 24, 26 having an extendible ram 42, 44. Although the preferred embodiment of the present invention is a hydraulically actuated cylinder, other fluid actuators, such as a pneumatically actuated cylinder and the like, are within the scope of the invention.

Figure 2:
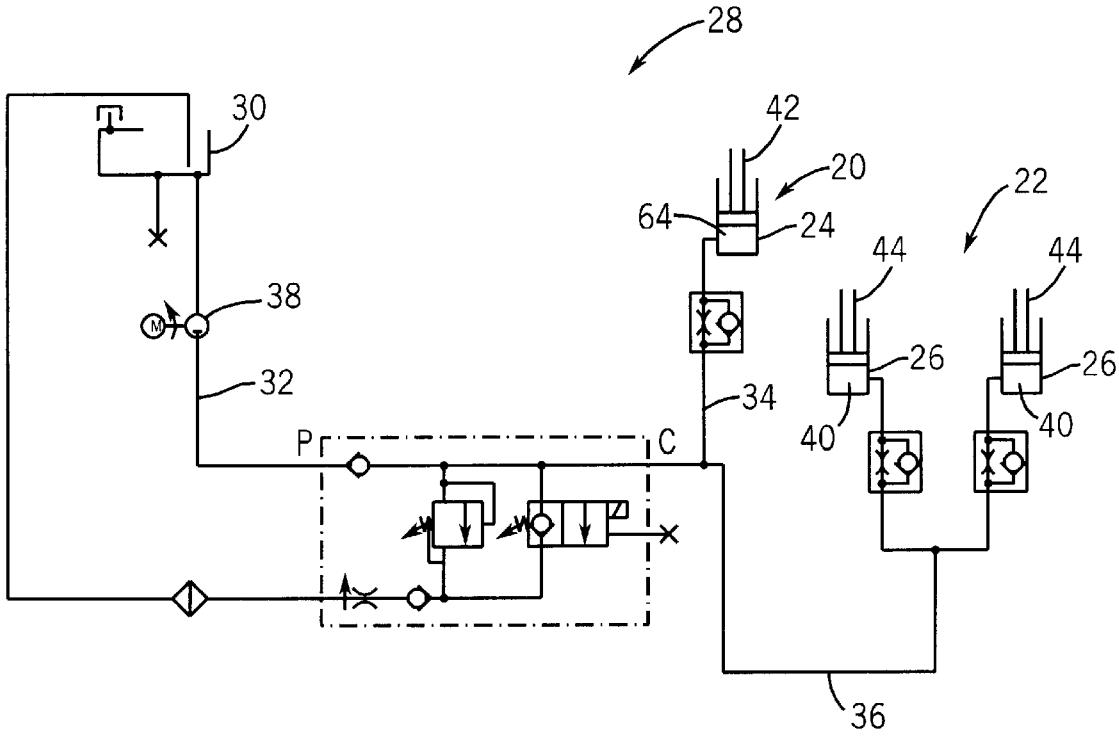
FIG. 2 is a schematic of a hydraulic circuit for actuating the mast assembly of the lift truck of FIG. 1.

Referring to FIG. 2, the first and second hydraulic stages 20, 22 are actuated by a hydraulic circuit 28 which includes a reservoir 30 for holding hydraulic fluid. The hydraulic fluid is pumped through a supply line 32 to a pair of parallel branch lines 34, 36, using methods known in the art, such as a pump 38. Each branch line 34, 36 supplies hydraulic fluid to one of the mast stages 20, 22. Hydraulic fluid pumped through each branch line 34, 36 actuates the respective hydraulic cylinders 24, 26 and extends the respective rams 42, 44 to raise the carriage 16 and forks 18.

The relative working pressures of the hydraulic cylinders 24, 26 ensures the proper sequential operation of the mast stages 20, 22. The working pressure of a particular cylinder is a function of the weight of the load lifted by the cylinder divided by the axially downwardly facing area of extendible ram. For example, the axially downwardly facing surface of ram 42 is identified in FIG. 3 by reference number 43. In the hydraulic cylinders 24, 26 disclosed herein, the working pressure of the first stage hydraulic cylinder 24 is less than the working pressures of the second stage hydraulic cylinders 26 to ensure that the hydraulic fluid pressure required to extend the first stage ram 42 is less than the hydraulic fluid pressure required to extend the second stage rams 44.

Referring to FIGS. 2–6, the mast assembly first hydraulic stage cylinder 24 includes the ram 42, which extends from a cylindrical elongated housing 46, and a cushioning assembly to minimize mast staging shock. The cushioning assembly includes a pressure ring 48 and piston plug 50 disposed in the housing 46, and increases the pressure in the first stage cylinder pressure chamber 64 to actuate the second stage cylinders 26 prior to the first stage cylinder 24 reaching the fully extended position. Advantageously, by actuating the second stage cylinders 26 while the first stage 20 is moving, the mast staging shock is reduced.

The first hydraulic stage cylinder housing 46 is fixed to the truck 10 and has an axial cylinder bore 52. The cylinder bore 52 has a closed lower end 54 and an open upper end 56. Preferably, the housing 46 is a tube having an open lower end which is closed by a plug 71 to close the bore lower end 54, and a cap 58 having an aperture 60 formed therein is fixed to the bore upper end 56. The ram size (length and axially facing area) is dependent upon the operating requirements of the lift truck. Although the housing and ram disclosed herein are cylindrical and have a circular cross section, any shaped bore and housing, such as a polygonal shape, elliptical shape, and the like, which can accommodate the ram and cushioning assembly can be used without departing from the scope of the present invention.

A manifold 62 fixed to the housing 46 is in fluid communication with the cylinder bore 52. The manifold 62 supplies hydraulic fluid from the hydraulic circuit 28 to the pressure chamber 64 when the ram 42 is being extended, and allows fluid to flow back toward the reservoir 30 in the hydraulic circuit 28 when the ram moving toward the retracted position.

The extendible ram 42 has an elongated body 66, such as a tube, with a lower end 68 disposed in the cylinder bore 52 and an upper end 70 extending out of the cylinder bore 52 through the cap aperture 60. The ram body 66 slidably and sealingly engages the cap 58 for axial movement in the cylinder bore 52, and to close the cylinder bore upper end 56 to define the pressure chamber 64 in the cylinder bore 52. The ram upper end 70 is fixed relative to the carriage 16. Hydraulic fluid pumped into the pressure chamber 64 urges the ram 42 from a retracted position to an extended position to raise the carriage 16.

Three screws 72 (only one is shown) spaced circumferentially 120° apart extend through holes 74 formed in the cylinder housing wall 76. The screws 72 extend into the cylinder bore 52, and engage a pressure ring 48 to prevent the ring 48 from sliding more than predetermined distances away from the cylinder bore upper end 56. Although an array of three screws is preferred, any mechanism which can position the pressure ring a predetermined distance from the cylinder bore upper end, such as stops formed in the cylinder bore wall, a retention device attached to the cap and ring, and the like, can be used without departing from the scope of the present invention. A bleed hole screw 80 threadably engages a bleed hole 82 formed through the cylinder housing wall 76 proximal the cylinder bore upper end 56, and plugs the bleed hole 82 until required to bleed hydraulic fluid from the pressure chamber 64.

A cylindrical slide bearing 84 is slipped into the cylinder bore upper end 56, and has an inner bearing surface 85 which engages the ram 42 to slidably mount the ram 42 in the cylinder bore 52. A seal 86, such as O-ring, is interposed between the cylinder housing wall 76 and the slide bearing 84 to prevent fluid from passing therebetween. Preferably, a radially outwardly opening notch 88 is formed in the slide bearing 84 to retain the seal 86 in place. A wear ring 87 can be provided which engages the ram 42 to further reduce friction.

A top 89 of the slide bearing 84 is stepped radially outwardly to engage the housing top 56, and form an annular cavity 90 for receiving a ram seal 92. Advantageously, the stepped top 89 prevents the slide bearing 84 from completely sliding axially into the cylinder bore 52 toward the bore lower end 54. The annular ram seal 92 engages the cylindrical ram body 66, and seals the pressure chamber 64 to prevent hydraulic fluid from escaping from the cylindrical bore 52. The ram seal 92 is held in the annular cavity 90 by the cap 58.

The cap 58 threadably engages the housing 46, and includes the aperture 60 through which the ram 42 extends. The cap 58 engages the slide bearing 84, and prevents the slide bearing 84 from sliding axially out of the cylinder bore 52. An annular cavity 94 formed in the cap top 96 receives a wiper seal 98 which engages the ram body 66 to further reduce the amount of fluid which escapes from the pressure chamber 64 through the cylinder bore upper end 56.

The first stage hydraulic cylinder cushioning assembly reduces shock loads encountered during the transition between the first and second hydraulic stages 20, 22. The cushioning assembly includes the pressure ring 48 which is slidably and sealingly mounted in the cylinder bore 52 between the piston plug 50 fixed to the ram lower end 68 and the cylinder bore upper end 56. The piston plug 50 engages the pressure ring 48 to trap fluid above the pressure ring 48, and increases the load on the ram 42 to increase the working pressure required to further advance the ram 42. Advantageously, the increased working pressure requirement for the first stage hydraulic cylinder 24 raises the fluid pressure in the hydraulic circuit 28 above the working pressure of the second stage hydraulic cylinders 26, and causes the mast assembly second hydraulic stage 22 to begin lifting before the first hydraulic stage 20 reaches the fully extended position.

The pressure ring 48 is an annular member having an inner diameter 100 through which extends the ram 42. The portion of the ram 42 extending through the ring inner diameter 100 has an outer diameter 102 which is less than the ring inner diameter 100 to provide a fluid passageway past the pressure ring 48 between the ring 48 and the ram 42. The fluid passageway is sealed when the piston plug 50 engages the pressure ring 48 and urges the pressure ring 48 toward the cylinder bore upper end 56.

A seal 112 received in an annular groove 110 formed in the pressure ring outer diameter 106 sealingly engages the cylinder housing wall 76 to prevent fluid from passing between the pressure ring 48 and cylinder housing wall 76. Preferably, the seal 112 is a cup or check type seal which seals the gap between the pressure ring 48 and cylinder housing wall 76 when the ring 48 is moving in an upward direction, and allows fluid to pass through the gap when the ring 48 is moving in a downward direction.

An orifice 114 extending between the inner diameter 100 and outer diameter 106 of the pressure ring 48 is in fluid communication with an axial groove 104 formed in the pressure outer diameter 106. The groove 104 extends downwardly from the orifice 114, and is in fluid communication with the pressure chamber 64 below the pressure ring 48. Advantageously, the groove 104 places the orifice 114 in fluid communication with the pressure chamber 64 below the pressure ring 48.

The orifice 114 and groove 104 provide a passageway for fluid trapped above the pressure ring 48 when the piston plug 50 engages the pressure ring 48. Advantageously when the piston plug 50 engages the pressure ring 48, the orifice 114 and groove 104 provide a restricted passageway for a controlled flow of fluid from above the pressure ring 48 to below the pressure ring 48. The controlled flow of fluid allows the ram 42 to continue to extend against the resistance caused by the trapped fluid.

A compression spring 116 biases the pressure ring 48 against the lower screws 72 when the ring 48 is not engaging the piston plug 50. Although a spring biasing the pressure ring 48 is preferred, the pressure ring 48 can slide freely between the cylinder bore upper end 56 and lower screws 72 without a biasing member, or other mechanisms for biasing the ring toward the cylinder bore lower end 54, such as a tension spring, and the like, can be used without departing from the scope of the present invention.

Figure 7:
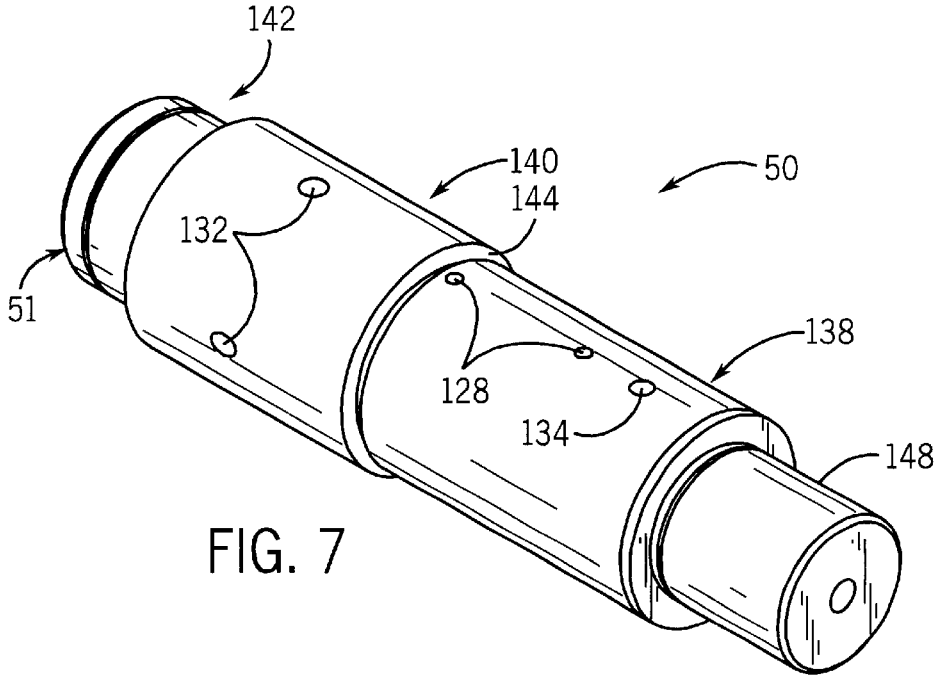
FIG. 7 is a perspective view of the piston plug of FIG. 3.
Figure 3:
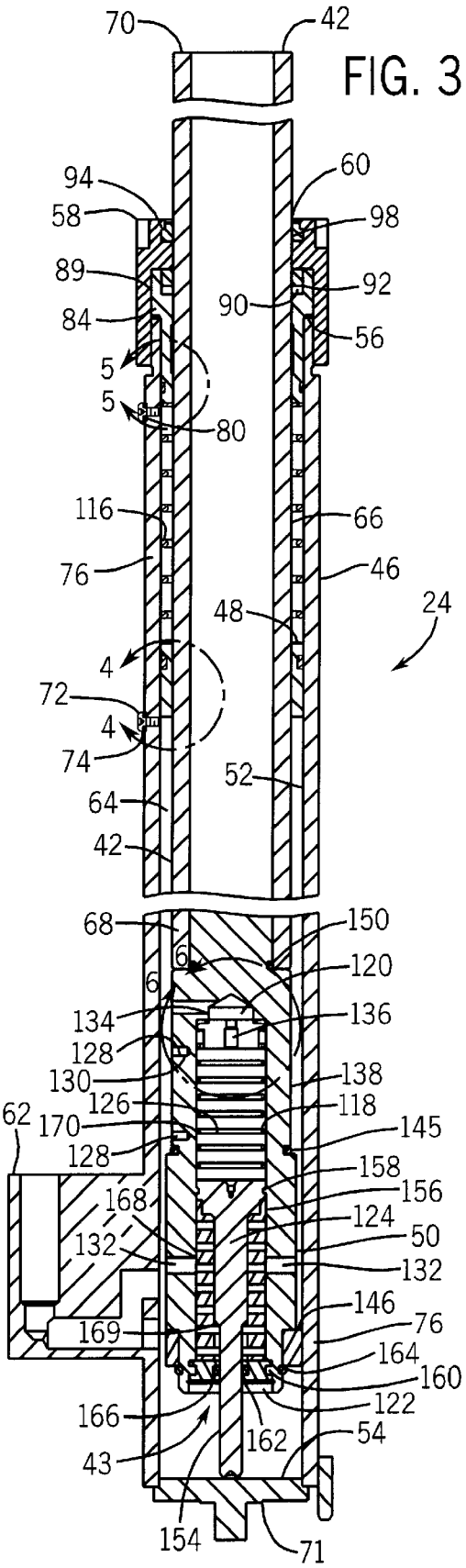
FIG. 3 is a cross sectional view of a hydraulic cylinder for the first stage of the mast assembly of the lift truck of FIG. 1.
Figure 4:
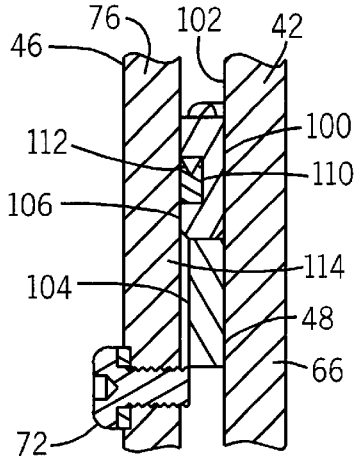
FIG. 4 is a detailed view along line 4—4 of FIG. 3.
Figure 5:
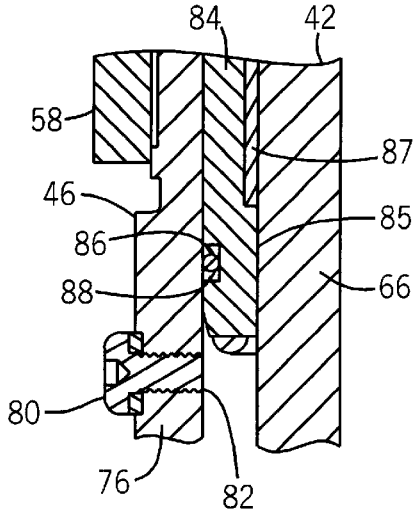
FIG. 5 is a detailed view along line 5—5 of FIG. 3.
Figure 6:
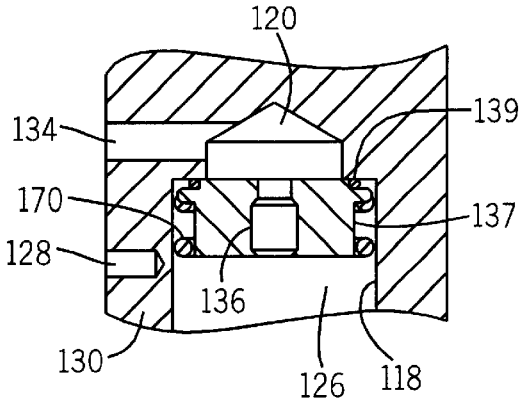
FIG. 6 is a detailed view along line 6—6 of FIG. 3.

Referring to FIGS. 3 and 7, the piston plug 50 is fixed to the ram lower end 68, and engages the pressure ring 48 to reduce mast staging shocks. The piston plug 50 includes a body 51 having an upper cylindrical section 138, a central cylindrical section 140, and a lower cylindrical section 142. The upper cylindrical section 138 has an outer diameter which is less than the inner diameter of the pressure ring 48 and the outer diameter of the central cylindrical section 140 to form a step 144 which engages the pressure ring 48 as the ram 42 moves toward the extended position.

A slide bearing 146 surrounds the lower cylindrical section 142, and engages the cylinder housing wall 76 to slidably mount the piston plug 50 in the cylinder bore 52. Preferably, an annular seal 145, such as an O-ring, is wrapped around the upper cylindrical section 138, and abuts the step 144. The seal 145 engages the pressure ring 48 to seal the passageway through the pressure ring inner diameter 100 when the piston plug 50 engages the ring. 48

A cylindrical nose 148 extending coaxially upwardly from the upper cylindrical section 138 is received in the elongated body 66 of the ram 42. Preferably, the nose 148 is press fit into the body 66, and a seal 150, such as an O-ring, is interposed between the body 66 and nose 148, to prevent hydraulic fluid from leaking into the body interior. Although press fitting the piston plug cylindrical nose 148 into the ram body 66 is shown, other methods for fixing the piston plug 50 to the ram body 66 can be used, such as threadably engaging the piston plug 50 with the ram body 66, welding, and the like, without departing from the scope of the present invention.

An axial bore 118 formed in the piston plug 50 has a closed upper end 120 and a lower end 122 opening to the cylinder bore lower end 54. A piston 124 extending into the piston plug bore open end 122 defines a variable volume 126 between the piston 124 and piston plug bore upper end 120 for accumulating fluid when the piston plug 50 engages the pressure ring 48. Orifices 128 formed in the piston plug wall 130 provide passageways for dissipating hydraulic fluid trapped in the volume 126 between the piston 124 and the piston plug bore upper end 120. Holes 132 formed in the piston plug wall 130 proximal the piston bore lower end 122 allow free flow of fluid into and out of the piston plug bore 118 between the piston 124 and the piston plug lower end 122.

A port 134 is formed in the piston plug wall 130, and provides a passageway through the piston plug wall 130 into the piston plug axial bore upper end 120 for fluid trapped above the pressure ring 48 when the piston plug 50 engages the pressure ring 48. Fluid flow through the port 134 is restricted by a bore plug 137, which acts as a first check valve, and a second check valve 136 interposed between the port 134 and piston 124.

The bore plug 137 is slidably mounted in the piston plug bore volume 126 between the piston plug bore upper end 120 and the piston 124, and regulates the flow of fluid through the port 134. A seal 139, such as an O-ring, interposed between the bore plug 137 and piston plug bore upper end 120 engages a step 119 formed in the bore 118 when the bore plug 137 is urged upwardly, such as when the fluid pressure in the volume 126 is greater than the fluid pressure in the piston plug bore upper end 120. When engaged with the step 119, the seal 139 prevents the flow of fluid from the volume 126 through the port 134. Advantageously, when the fluid pressure in the piston plug bore upper end 120 is greater than the fluid pressure in the volume 126, such as when fluid is trapped above the pressure ring 48, the bore plug 137 slidably moves downwardly away from the piston plug bore upper end 120 to disengage the seal 139 from the step 119, and allow fluid to flow through the port 134, around the bore plug 137, and into the volume 126.

The second check valve 136 disposed in the bore plug 137 provides a pathway through the bore plug 137 for fluid flowing through the port 134 into the volume 126. The check valve 136 allows hydraulic fluid to flow through the port 134 into the volume 126, and prevents hydraulic fluid from flowing out of the piston plug volume 126 through the port 134. Advantageously, the check valve 136 in combination with the slidable bore plug 137 allows a sufficient volume of fluid to flow through the port 134 to quickly position the piston 124 prior to the piston plug 50 engaging the pressure ring 48.

The piston 124 has a head 152 slidably and sealingly mounted in the piston plug axial bore 118, and has an end 154 extending out of the axial bore open end 122 toward the cylinder bore lower end 54. The piston 124 acts as a dashpot to control deceleration of the ram 42 as the ram 42 approaches the retracted position, and controls the fluid pressure of the fluid trapped above the pressure ring 48 when the piston plug 50 engages the pressure ring 48 as the ram 42 approaches the extended position. Advantageously, by controlling the pressure of the fluid trapped above the pressure ring 48 when the piston plug 50 engages the pressure ring 48, mast staging shocks are significantly reduced.

The piston head 152 includes a wear ring 156 and a piston ring 158 which engages the piston plug axial bore wall 130. Preferably, the piston ring 158 is cast iron which can withstand the pressures in the volume 126, and can pass over and shut off the orifices 128 formed in the piston plug wall 130 to improve the deceleration of the ram 42 as the piston 124 moves axially in the piston plug bore 118 as a result of engaging the cylinder bore lower end 54. The wear ring 156 reduces friction while radially centering the piston head 152 in the piston plug bore 118, and is, preferably, formed from a glass filled polyamide material which is internally lubricated with molybdenum disulfide. Although the above materials are preferred, piston rings and wear rings formed from other materials well known in the art can be used without departing from the scope of the present invention.

A retainer ring 160 is fixed in the piston plug bore 118 proximal the piston bore lower end 122, and includes an aperture 162 through which the piston end 154 extends. A seal 164, such as an O-ring, is disposed between the retainer ring 160 and the piston plug wall 130 to prevent fluid from passing between the retainer ring 160 and piston plug wall 130 into the piston plug axial bore 118. A second seal 166, such as an O-ring, is disposed between the inwardly facing surface of the aperture 162, and slidingly engages the piston end 154.

An accumulator spring 168 interposed between the piston head 152 and piston plug bore lower end 122 urges the piston head 152 towards the piston plug bore upper end 120. A step 169 in the piston end 154 engages the retainer ring 160 to limit the piston 124 travel, and thus the compression of the accumulator spring 168. The limit on the piston 124 travel protects the accumulator spring 168 from over compression.

The accumulator spring 168 controls the fluid pressure of the fluid trapped above the pressure ring 48 when the piston plug 50 engages the pressure ring 48 as the ram 42 moves toward the extended position. The accumulator spring 168 allows the piston 124 to move in an axial direction to increase the volumetric capacity of the volume 126. The increasing capacity of the volume 126 accumulates fluid forced through the port 134 in response to the increased fluid pressure above the pressure ring 48. Advantageously, the accumulator spring 168 regulates the fluid pressure in the volume 126, and above the pressure ring 48 when the piston plug 50 engages the pressure ring 48, in proportion to the spring constant of the accumulator spring 168 to minimize hydraulic shocks in the cylinder 24.

A deceleration return spring 170 interposed between the piston head 152 and the axial bore upper end 120 positions the piston head 152 in the piston plug bore 118 so that the volume 126 has a predetermined volumetric capacity when the piston plug 50 is not engaged with the pressure ring 48. Advantageously, when the ram 42 is extending toward the extended position, the deceleration spring 170 positions the piston head 152 so that the volume 126 has the predetermined volumetric capacity for accumulating fluid prior to the piston plug 50 engaging the pressure ring 48. When the ram 42 approaches the retracted position, hydraulic fluid in the volume 126 is forced out of the orifices 128 when the piston end 154 engages cylinder lower end 54. Forcing the fluid out of the orifices 128 when the piston end 154 engages the cylinder lower end 54 decelerates the ram 42 as the ram 42 approaches the retracted position.

In operation, the first hydraulic stage 20 is actuated to move toward the extended position by pumping hydraulic fluid into the first stage hydraulic cylinder pressure chamber 64. Initially, the fluid is pumped into the pressure chamber 64 through the manifold 62, and flows through the gap between the pressure ring 48 and ram 42 to fill the pressure chamber 64 above and below the pressure ring 48. As the pressure inside the pressure chamber 64 increases, the ram 42 is urged upwardly, toward the extended position. Fluid in the pressure chamber 64 can flow freely past the pressure ring 48 until the piston plug 50 engages the ring 48. Of course, once the pressure chamber 64 is filled with fluid, subsequent actuation of the first hydraulic stage only requires pumping fluid into the pressure chamber 64 to increase the fluid pressure in the chamber 64.

When the piston plug 50 engages the pressure ring 48, the piston plug nose 148 and upper cylindrical section 138 extend through the pressure ring 48 such that the port 134 is disposed above the pressure ring 48, and the gap between the ring 48 and ram 42 is sealed by the step 144 and seal 145 engaging the ring 48. Once the gap between the ring 48 and ram 42 is sealed, the hydraulic fluid trapped above the ring 48 is forced through the orifice 114 in the pressure ring 48 and into the port 134 in the piston plug 50. The constricted flow of fluid through the orifice 114 increases the fluid pressure above the ring 48, and increases the fluid pressure required in the pressure chamber 64 to further extend the ram 42 toward the extended position.

As the fluid pressure in the pressure chamber 64 increases to continue extending the ram 42, the pressure threshold to activate the second hydraulic stage 22 is exceeded, and the second hydraulic stage rams 44 begin to extend before the first hydraulic stage ram 34 reaches the extended position. Advantageously, by increasing the fluid pressure requirements in the mast first stage assembly 20 as the mast first stage assembly 20 approaches the extended position and initiates the second hydraulic stage 22, hydraulic fluid is increasingly diverted from the first stage 20 to the second stage 22, and the second stage rams 44 accelerate as the first stage ram 42 decelerates to provide a smooth mast staging transition.

The hydraulic fluid above the pressure ring 48 flowing through the port 134 passes through the check valve 136 into the piston plug axial bore volume 126 which expands to accumulate hydraulic fluid and minimize a hydraulic shock resulting from the piston plug 50 engaging the pressure ring 48. The hydraulic fluid entering the piston plug axial bore volume 126 urges the piston 124 against the accumulator spring 168, and the fluid pressure above the pressure ring 48 increases in relation to the spring constant of the accumulator spring 168. As the ram 42 extends further toward the extended position, the fluid pressure above the pressure ring 48 increases, and the amount of fluid dissipated through the pressure ring orifice 114 increases to maintain the pressure of the hydraulic fluid above the pressure ring 48. As a result, a sudden change in hydraulic fluid pressure, which can produce a hydraulic shock, resulting from the piston plug 50 engaging the pressure ring 48 is avoided, and a smooth transition between stages 20, 22 is accomplished.

Descent of the first and second stage rams 42, 44 is accomplished by allowing the hydraulic fluid pressure in the hydraulic circuit 28 to drop. Once the fluid pressure in the hydraulic circuit 28 is reduced below the working pressure of the second stage hydraulic cylinders 26, the second hydraulic stage rams 44 begins to retract. When the fluid pressure in the hydraulic circuit 28 falls below the working pressure of the first stage hydraulic cylinder 24, the ram 42 in the first hydraulic stage 20 begins to move toward the retracted position.

Preferably, as soon as the first hydraulic stage ram 42 stops moving toward the extended position, the accumulator spring 168 urges the piston 124 in the piston plug bore 118 to a position below the piston plug orifices 128. The piston 124 is repositioned in the piston plug bore 118 in order for the cushioning assembly to cushion the first hydraulic stage ram 42 as the ram 42 approaches the retracted position.

When the first hydraulic stage ram 42 is being retracted, the cushioning assembly cushions the ram 42 as the ram 42 reaches the fully retracted position. As the ram 42 approaches the retracted position, the piston end 154 of piston 124 engages the cylinder bore lower end 54, and forces the piston head 152 upwardly in the piston plug bore 118. The fluid in the piston plug bore 118 between the piston head 152 and the check valve 136 is blocked from passing through the port 134 in the piston plug 50 by the check valve 136, and is forced out of the orifices 128. The restricted flow of fluid through the orifices 128 acts as a dashpot to decelerate the ram 42 moving toward the retracted position. Preferably, the fluid is initially forced out of two orifices 128. However, as the piston head 152 moves upwardly in the piston plug bore 118, the piston head 152 passes over the lower orifice 128, and continued downwardly movement of the ram 42 results in fluid being forced out the remaining orifice 128 in fluid communication with the volume 126, thus further slowing the downwardly movement of the ram 42 toward the retracted position.

Figure 8:
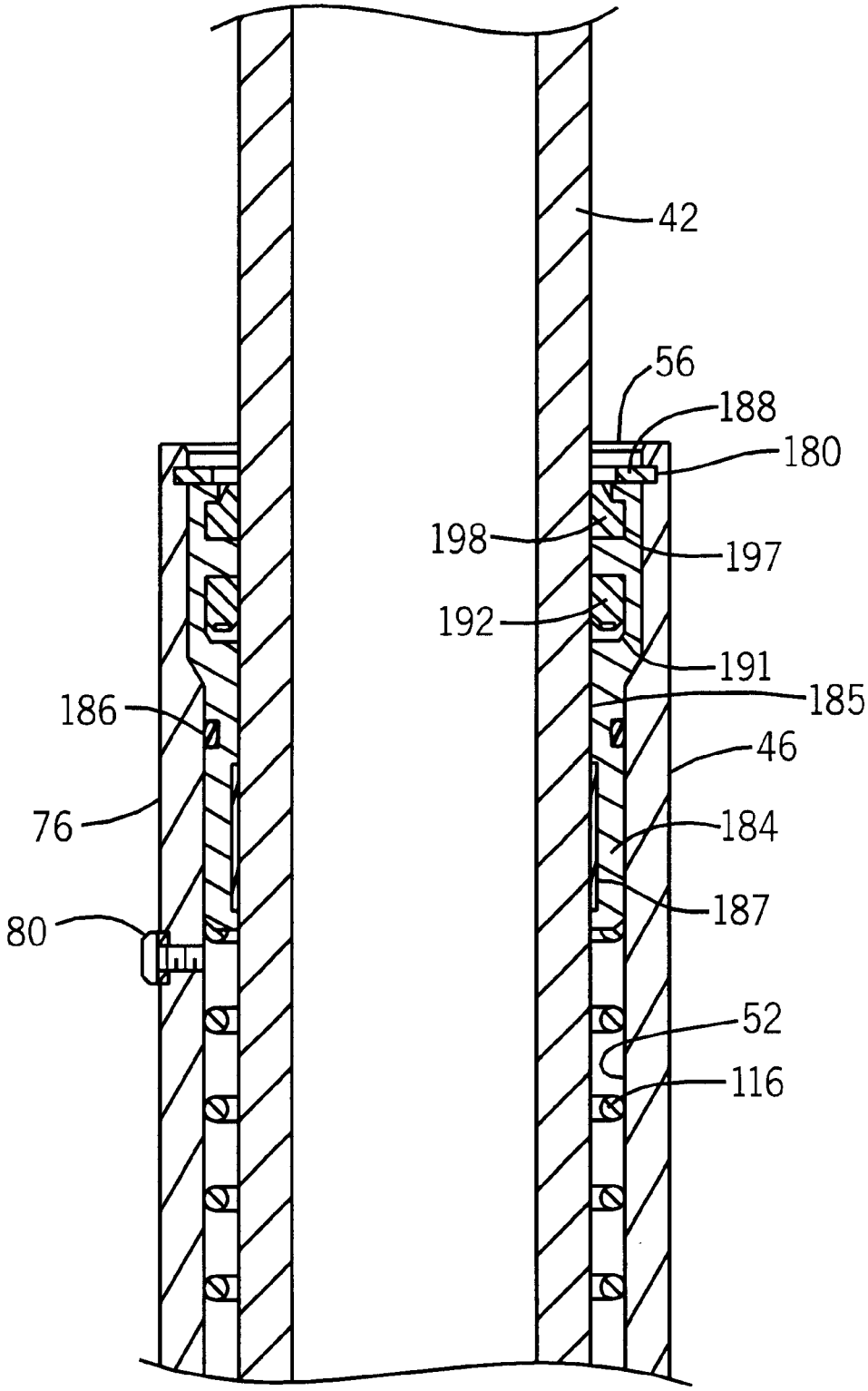
FIG. 8 is a detailed cross sectional view of an alternative method of retaining a slide bearing in the cylinder housing.

In an alternative embodiment, shown in FIG. 8, a cylindrical slide bearing 184 is slipped into the cylinder bore upper end 56, and has an inner bearing surface 185 which engages the ram 42 to slidably mount the ram 42 in the cylinder bore 52. A seal 186, such as O-ring, is interposed between the cylinder housing wall 76 and the slide bearing 184 to prevent fluid from passing therebetween, such as in the first embodiment described above. A wear ring 187 can be provided which engages the ram 42 to further reduce friction. Seals 192, 198 are received in inwardly opening notches 191, 197 formed in the inner diameter of the slide bearing 184, and engage the ram 42 to prevent fluid from passing therebetween. The slide bearing 184 is retained in the cylinder bore 52 by a snap ring 188 engaging an inwardly opening notch 180 formed in the cylinder housing wall 76.

While there has been shown and described what are at present considered the preferred embodiments of the invention, it will be obvious to those skilled in the art that various changes and modifications can be made therein without departing from the scope of the invention defined by the appended claims.

We claim:

1. An actuator for use with a lift truck having an extendible mast, said actuator comprising:

an elongated housing;

an axial bore formed in said housing, and having a first end and a second end;

a ram slidably and sealingly mounted in said bore for axial movement between an extended ram position and a retracted ram position, said ram having one end disposed in said bore and an opposing end extending out of said bore second end; and a pressure ring slidably and sealingly mounted in said bore between said ram one end and said bore second end, wherein filling said bore with a fluid causes said ram to move from the retracted ram position toward the extended ram position, and engagement of said ram one end with said pressure ring traps fluid between said pressure ring and said bore second end to resist movement of said ram toward the extended ram position.

2. The actuator as in claim 1, in which said pressure ring is biased toward said bore first end by a spring.

3. The actuator as in claim 1, in which said pressure ring has an inner diameter and said ram has an outer diameter, wherein said pressure ring inner diameter is greater than said ram outer diameter to provide a fluid passageway past said pressure ring between said pressure ring and said ram, and said fluid passageway is sealed when said ram one end engages said pressure ring.

4. The actuator as in claim 1, in which an orifice in fluid communication with said axial bore between said pressure ring and said axial bore first end is formed in said pressure ring, and said orifice provides a passageway for fluid trapped between said pressure ring and said second end of said bore formed in said housing when said ram one end engages said pressure ring.

5. The actuator as in claim 4, in which a groove formed in an outer surface of said pressure ring placed said orifice in fluid communication with said axial bore between said pressure ring and said axial bore first end.

6. The actuator as in claim 1, in which a seal sealingly engages an outer diameter of said pressure ring and said bore.

7. The actuator as in claim 1, in which said ram one end includes;

a piston plug body;

an axial piston plug bore formed in said piston plug body, and having a first end and a second end, said piston plug bore first end being in fluid communication with said bore formed in said housing;

a piston slidably and sealingly mounted in said piston plug bore, and having an end extending out of said piston plug bore second end toward said first end of said bore formed in said housing; and an accumulator biasing member urging said piston away from said piston plug bore second end.

8. The actuator as in claim 7, in which a deceleration biasing member disposed in said piston plug bore urges said piston toward said piston plug bore second end.

9. The actuator as in claim 8, in which said deceleration biasing member is a compression spring.

10. The actuator as in claim 7, in which said piston plug bore is in fluid communication with said bore formed in said housing through a port formed in said piston plug body, and said port provides a passageway for fluid trapped between said pressure ring and said second end of said bore formed in said housing.

11. The actuator as in claim 7, in which a check valve is disposed in said passageway.

12. The actuator as in claim 7, in which said accumulator biasing member is a compression spring.

13. The actuator as in claim 7, in which a t least one orifice is formed in said piston plug body, wherein said piston plug axial bore is in fluid communication with said axial bore formed in said housing through said at least one orifice.

14. An actuator for use with a lift truck having an extendible mast, said actuator comprising:

an elongated housing an axial ram bore formed in said housing, and having a first end and a second end;

a ram slidably and sealingly mounted in said ram bore for axial movement between an extended position and a retracted position, said ram having one end disposed in said ram bore and an opposing end extending out of said ram bore second end;

a piston plug having a body fixed to said ram one end;

an axial piston plug bore formed in said piston plug body, and having a first end and a second end;

a port formed in said piston plug body, and defining a passageway between said piston plug bore and said ram bore;

a check valve disposed in said passageway, wherein said check valve discourages fluid from flowing out of said piston plug bore first end through said port;

a piston slidably and sealingly mounted in said piston plug axial bore, and having an end extending out of said piston plug bore second end toward said first end of said ram bore;

an accumulator biasing member urging said piston toward said piston plug bore first end; and a pressure ring slidably and sealingly mounted in said ram bore between said piston plug and said ram second end, wherein filling said ram bore with a fluid causes said ram to move from the retracted position toward the extended position, and engagement of said piston plug traps fluid between said pressure ring and said ram bore second end to resist movement of said ram toward the extended position and, and at least a portion of said trapped fluid flows into said piston plug axial bore through said passageway, and said portion of said trapped fluid urges said piston against said accumulator biasing mechanism.

15. The actuator as in claim 14, in which a deceleration biasing mechanism is disposed in said piston plug bore, and urges said piston toward said piston plug axial bore second end.

16. The actuator as in claim 15, in which said deceleration biasing member is a compression spring.

17. The actuator as in claim 14 in which said pressure ring is biased toward said bore first end by a spring.

18. The actuator as in claim 14, in which said pressure ring has an inner diameter and said ram has an outer diameter, wherein said inner diameter is greater than said outer diameter to provide a fluid passageway past said pressure ring between said pressure ring and said ram, and said fluid passageway is sealed when said piston plug engages said pressure ring.

19. The actuator as in claim 14, in which an orifice in fluid communication with said axial bore between said pressure ring and said axial bore first end is formed in said pressure ring, and said orifice provides a passageway for fluid trapped between said pressure ring and said second end of said bore formed in said housing when said ram one end engages said pressure ring.

20. The actuator as in claim 19, in which a groove formed in an outer surface of said pressure ring placed said orifice in fluid communication with said axial bore between said pressure ring and said axial bore first end.

21. The actuator as in claim 14, in which a seal sealingly engages an outer diameter of said pressure ring and said ram bore.

22. The actuator as in claim 14, in which said accumulator biasing member is a compression spring.

23. The actuator as in claim 14, in which at least one orifice is formed in said piston plug body, wherein said piston plug axial bore is in fluid communication with said ram bore through said at least one orifice.

24. A piston plug fixable to a an end of a ram, said piston plug comprising:

a body;

an axial bore formed in said piston plug body, and having a first end and a second end;

a port formed in said piston plug body;

a piston slidably and sealingly mounted in said piston plug axial bore, and having an end extending out of said piston plug bore second end;

a check valve interposed between said piston and said port, wherein said check valve discourages fluid from flowing out of said axial bore first end through said port; and an accumulator biasing member urging said piston away from said piston plug axial bore open end.

25. The piston plug as in claim 24, in which a deceleration biasing mechanism is disposed in said piston plug bore, and urges said piston toward said piston plug axial bore second end.

26. The piston plug as in claim 25, in which said deceleration biasing member is a compression spring.

27. The piston plug as in claim 24, in which said accumulator biasing member is a compression spring.

28. The piston plug as in claim 24, in which at least one orifice is formed in said piston plug body, wherein said piston plug axial bore is in fluid communication with said ram bore.

29. A multistage mast assembly for use with a lift truck, said assembly comprising:

a first mast stage having a retracted mast position and an extended mast position;

a second mast stage supporting said first mast stage;

an actuator interposed between said first and second mast stages, and including:

an elongated housing;

an axial bore formed in said housing, and having a first end and a second end;

a ram slidably and sealingly mounted in said bore for axial movement between an extended ram position and a retracted ram position, said ram having one end disposed in said bore and an opposing end extending out of said bore second end; and a pressure ring slidably and sealingly mounted in said bore between said ram one end and said bore second end, wherein filling said bore with a fluid causes said ram to move from the retracted ram position toward the extended ram position, and engagement of said ram one end with said pressure ring traps fluid between said pressure ring and said bore second end to resist movement of said ram toward the extended ram position;

wherein, one of said housing and said ram is fixed to said second mast stage, and the other of said housing and said ram is fixed to said first mast stage, and movement of said ram from the retracted ram position toward the extended ram position moves said first mast stage between the retracted position and the extended position.

* * * * *